United States Patent [19]

Johnstone

[11] 4,228,484

[45] Oct. 14, 1980

[54] LED FLASHER FOR BATTERY CELL-POWERED LAMP

[76] Inventor: Malcolm D. Johnstone, Little Sunapee Rd., New London, N.H. 03257

[21] Appl. No.: 966,354

[22] Filed: Dec. 4, 1978

[51] Int. Cl.[3] ..... F21V 33/00

[52] U.S. Cl. ..... 362/184; 362/202; 362/800

[58] Field of Search ..... 362/800, 202, 184

[56] References Cited

U.S. PATENT DOCUMENTS 3,609,344 9/1971 So ..... 362/184

*Primary Examiner*—Stephen J. Lechert, Jr.

*Attorney, Agent, or Firm*—Thomas N. Tarrant

[57] ABSTRACT

An LED flasher circuit is attached to a battery-cell-powered lamp and connected to the battery power source to provide a finding aid for the battery lamp in the dark.

7 Claims, 3 Drawing Figures

LED FLASHER FOR BATTERY CELL-POWERED LAMP

BACKGROUND OF THE INVENTION

1. Field of the Invention

This invention relates to the use of an LED (light emitting diode) which periodically flashes "on" to aid in finding a battery cell-powered lamp in the dark.

2. Description of the Prior Art

Incandescent "flasher" bulbs have been used in flashlights as disclosed, for example, in U.S. Pat. Nos. 3,053,978 and 3,609,344. The high current drain on the batteries, however, precludes the use of continually flashing "flasher" bulbs to function as a finding aid for locating a battery lamp in the dark.

The use of luminescent or phosphorescent material as an auxiliary light source has been suggested to aid in finding a flashlight in the dark as disclosed, for example, in U.S. Pat. Nos. 1,285,382 and 4,052,610. However, the light emitted from such material is generally fairly dim and of a relatively constant intensity which is bound to be unnoticed.

SUMMARY OF THE INVENTION

One aspect of the present invention resides in the improvement to a battery cell-powered lamp having an auxiliary light source to aid in finding the lamp in the dark. The improvement comprises an LED flasher circuit attached to the battery cell-powered lamp wherein an LED is proximate the outer body of the lamp and wherein the LED flasher circuit is energized by a battery cell-power source of the lamp.

Another aspect of the present invention resides in providing a flashlight comprising: a body having a first end and a second end; an endcap which attaches to the body at the first end; a head which attaches to the body at the second end; a module containing an LED flasher circuit attached to an inside of the endcap wherein a substantial portion of an LED is visible; a first conductor running from a switch for a lamp to a portion of the body proximate the first end; a second conductor attached to the module, connected to the LED flasher circuit, adapted to be connected to a cathode of a cell, and having a portion which automatically connects to the first conductor when the endcap is attached to the body; a third conductor running substantially from the first end to the second end of the body; a fourth conductor located in the endcap, connected to the LED flasher circuit, and having a portion which automatically connects to the third conductor when the endcap is attached to the body; and, connection means to automatically connect the fourth conductor with a conducting member which is connected to an anode terminal of the lamp.

It is accordingly an object of the present invention to provide a novel aid for finding a battery cell-powered lamp in the dark which includes the use of an LED which periodically flashes "on".

Another object is to provide a novel, flashing, auxiliary light source to aid in the finding of a battery cell-powered lamp in the dark which draws a minute current compared with the main lamp.

Still another object is to provide a flashlight incorporating an LED flasher circuit which allows convenient access to the battery cells and lamp.

Other objects and features of the invention will become apparent upon reading the description of the preferred embodiment in conjunction with the drawing.

DESCRIPTION OF THE PREFERRED EMBODIMENT

Battery cell-powered LED flasher circuits are known in the art as disclosed, for example, in U.S. Pat. No. 3,737,722 or in the description of typical applications of a No. 3909 LED flasher/oscillator described in *Semiconductor Reference and Application Manual,* 1978 edition, page 45, published by Radio Shack, a Division of Tandy Corp., Fort Worth, Tex., herein incorporated by reference.

Figure 1:
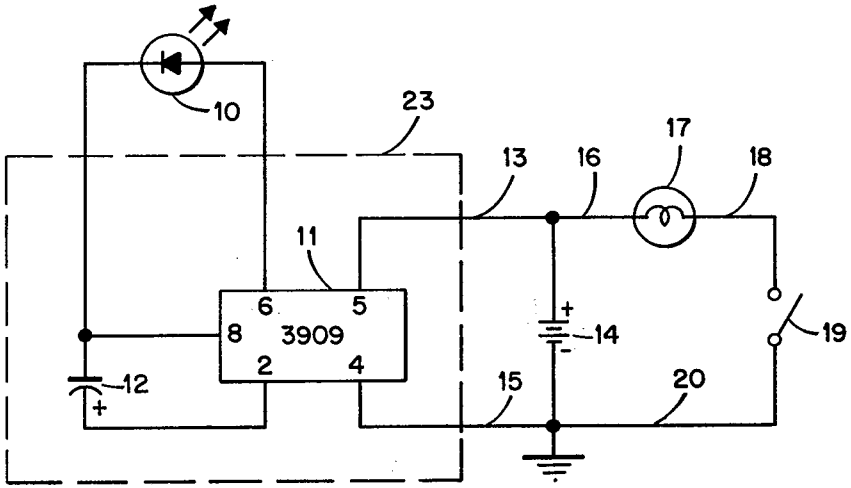
FIG. 1 is a schematic diagram partially in block according to the present invention.

FIG. 1 shows circuitry making use of an LED flashing circuit. The anode of LED 10 is connected to pin 6 of integrated circuit 11, which is a No. 3909 integrated circuit as described in the above incorporated reference. The cathode of LED 10 is connected both to pin 8 of integrated circuit 11 and to one side of capacitor 12. The other side of capacitor 12, which is the side with the positive voltage polarity, is connected to pin 2 of integrated circuit 11. Capacitor 12 is suitably an electrolytic type 300 uF capacitor with a 6-volt rating.

Conductor 13 connects pin 5 of integrated circuit 11 to the anode of battery 14. Conductor 15 connects pin 4 of integrated circuit 11 to the cathode of battery 14. Conductor 16 connects one terminal of incandescent lamp 17 to the anode of battery 14. The other terminal of incandescent lamp 17 is connected to the cathode of battery 14 through conductor 18, switch 19, and conductor 20 respectively.

Battery 14 is suitably embodied as a pair of 1.5 volt flashlight battery cells placed in series so that the voltage at the anode of battery 14 is close to 3 volts with respect to the cathode of battery 14. Incandescent lamp 17 is suitably embodied as a flashlight light bulb for the corresponding battery or batteries which comprise battery 14.

With the circuit of FIG. 1, the average current drain from battery 14 to power the circuit is less than 1.0 milliamp. The normal flash rate for LED 10 is 1 hertz with a flash duration typically below 6 milliseconds.

Figure 2:
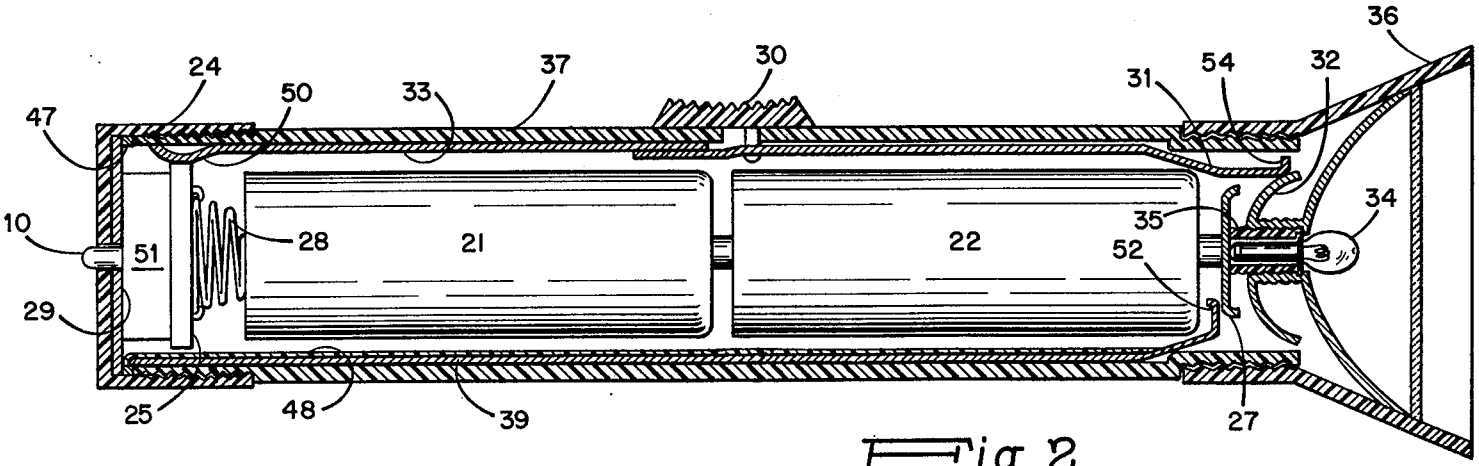
FIG. 2 is a sectional view of a flashlight incorporating the circuit of FIG. 1.

FIG. 2 illustrates a flashlight incorporating the circuit of FIG. 1. Cells 21 and 22 are conventional 1.5 volt "D" cells placed in series and comprise an embodiment of battery 14 of FIG. 1. Each terminal of LED 10 is connected into control circuitry 23 (shown in FIG. 1) which is embodied as potted flasher circuit 51. Potted flasher circuit 51 is bonded to conducting plate 29 which in turn is bonded to the inner surface of endcap 24. The conducting path from potted flasher circuit 51 to the anode of cell 22 includes metal ring 47 which is secured to the end of the male-threaded portion of body 37 adjacent endcap 24. Metal ring 47 contacts conducting plate 29 when endcap 24 is screwed onto body 37. Conducting plate 29 is connected to the circuitry within potted flasher circuit 51. Metal strip 39 is secured to the inner wall of body 37 and is directly connected to metal ring 47. Conducting plate 27 abuts the anode of cell 22 and contacts contact 52, which is formed from one end of metal strip 39, when head 36 is screwed onto body 37, thus completing the conducting path to the anode of cell 22.

The conducting path from potted flasher circuit 51 to the cathode of cell 21 includes metal cap 25 which covers the surface of potted flasher circuit 51 facing the cathode of cell 21. Spring 28 is secured to metal cap 25 and provides a conducting path from metal cap 25 to the cathode of cell 21. Metal cap 25 is connected to the circuitry within potted flasher circuit 51, thus completing the conducting path to the cathode of cell 21. To prevent metal cap 25 from contacting metal strip 39, plastic coating 48 insulates metal strip 39 in the vicinity of metal cap 25.

The conducting path from the cathode of cell 21 to lamp 34 includes spring 28 and metal cap 25. Brush contact 50 is formed on metal strip 33 by providing a curved bend whose convex portion contacts metal cap 25 when endcap 24 is screwed onto body 37. Metal strip 33 is secured to body 37 and terminates near switch 30. Metal strip 31 is attached to switch 30 and contact 54, formed from one end of metal strip 31, is moved thereby into contact with and out of contact with metal disk 32. Metal strip 31 always contacts metal strip 33 and slides against it when moved by switch 30. Metal disk 32 contacts the cathode terminal of lamp 34, thus completing the conducting path to lamp 30.

Conducting plate 27 is a base member secured to plastic sleeve 35 which screws into metal disk 32 to hold lamp 34 stationary. With this arrangement, head 36 may be unscrewed from body 37 to permit ready access to lamp 34 by unscrewing plastic sleeve 35. Likewise, endcap 24 may be unscrewed from body 37 to permit ready access to cells 21 and 22.

Figure 3:
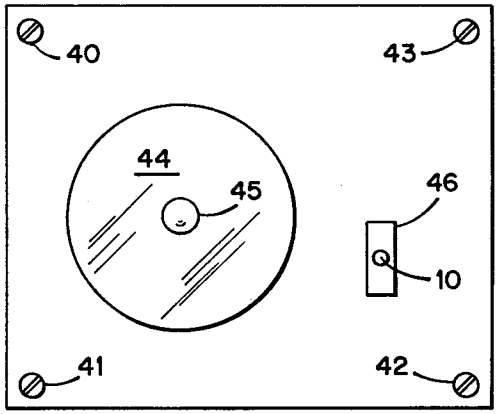
FIG. 3 is a front elevation of a battery cell-powered emergency wall lamp incorporating the circuit of FIG. 1.

FIG. 3 illustrates a battery cell-powered emergency wall lamp incorporating the circuit of FIG. 1. Screws 40 through 43 hold the emergency wall lamp on a wall; alternatively, the wall lamp could be hung on a bracket from a wall. Reflector 44 is suitably embodied as a conventional flashlight reflector. Incandescent lamp 45 and switch 46 are specific embodiments of lamp 17 and switch 19 respectively shown in FIG. 1. Positioned proximate switch 46 is LED 10. Control circuitry 23 is placed inside of the wall lamp. LED 10 is connected to control circuitry 23 and may be located directly on switch 46 as shown in FIG. 3; alternatively, it may be placed near switch 46. Thus, one need only find the flashing LED 10 in the dark and conveniently activate switch 46 to turn "on" the wall lamp.

Other variations will occur to those skilled in the art such as the use of fluorescent lights for the main lamp and all such variations are deemed to be within the scope of the appended claims except where expressly limited otherwise.

I claim:

1. In a lamp powered by self-contained electric cells and having an auxiliary light source to aid in finding the lamp in the dark, the combination in said auxiliary light source comprising:

(a) a flasher circuit contained within said lamp;

(b) means automatically connecting said flasher circuit directly to said self-contained electric cells upon installation of said cells; and (c) a light-emitting diode mounted in a visible location at the outer body of said lamp and connected directly to said flasher circuit, the flasher circuit being selected with components to provide a flashing rate to said light-emitting diode of at least 1 Hertz with an average current drain from said electric cells of less than 1.0 milliamperes.

2. The combination as claimed in claim 1 wherein the lamp is a flashlight.

3. The combination as claimed in claim 1 wherein the lamp is an emergency wall lamp.

4. The combination as claimed in claim 3 wherein the LED is positioned proximate a switch which operates the emergency wall lamp.

5. A flashlight comprising:

(a) a body having a first end and a second end;

(b) an endcap which attaches to the body at the first end;

(c) a head which attaches to the body at the second end;

(d) a module containing an LED flasher circuit attached to an inside of the endcap wherein a substantial portion of an LED is visible;

(e) a first conductor running from a switch for a lamp to a portion of the body proximate the first end;

(f) a second conductor attached to the module, connected to the LED flasher circuit, adapted to be connected to a cathode of a cell, and having a portion which automatically connects to the first conductor when the endcap is attached to the body;

(g) a third conductor running substantially from the first end to the second end of the body;

(h) a fourth conductor located in the endcap, connected to the LED flasher circuit, and having a portion which automatically connects to the third conductor when the endcap is attached to the body; and (i) connection means to automatically connect the fourth conductor with a conducting member which is connected to an anode terminal of the lamp.

6. A flashlight as claimed in claim 5 wherein the LED flasher circuit is a semiconductor circuit drawing less than 1.0 milliamp of average current.

7. The combination as claimed in claims 2, 3, 4, or 1 wherein said light-emitting diode is connected to operate continuously while active electric cells are in said lamp.

* * * * *